US005788067A

United States Patent [19]

Marcellis

[11] Patent Number: 5,788,067

[45] Date of Patent: Aug. 4, 1998

[54] GIFT WRAP GARMENT BAG

[76] Inventor: Sister Anita Marcellis, Convent of St. Elizabeth Box 476, Convent Station, N.J. 07961

[21] Appl. No.: 838,142

[22] Filed: Apr. 14, 1997

[51] Int. Cl.[6] ..... B65D 85/18; B65D 33/02

[52] U.S. Cl. ..... 206/280; 206/287; 206/287.1

[58] Field of Search ..... 206/280, 279, 206/287, 287.1; 383/9

[56] References Cited

U.S. PATENT DOCUMENTS

| | | | |
|---|---|---|---|
| 1,097,544 | 5/1914 | Goldberg | 206/287 X |
| 1,136,346 | 4/1915 | Krebs | 206/287 |
| 1,463,002 | 7/1923 | Bernstein | 206/287 |
| 1,651,706 | 12/1927 | Holbrook | 206/287 |
| 2,132,337 | 10/1938 | Whiteman | 206/287 X |
| 2,224,090 | 12/1940 | Tucker et al. | 206/287 |
| 2,278,185 | 3/1942 | Pearson | 206/287 X |
| 2,547,530 | 4/1951 | Mehl | 206/287 |
| 2,590,462 | 3/1952 | Rassenfoss | 206/287 |
| 2,635,740 | 4/1953 | Rubin | 206/287 |
| 2,997,167 | 8/1961 | Westfall, Jr. | 206/287 |
| 3,007,567 | 11/1961 | Rosen | 206/287 |

*Primary Examiner*—Sue A. Weaver

[57] ABSTRACT

A gift wrap garment bag including a bag comprising a front portion and a rear portion. The front portion and the rear portion each have an upper triangular section and a lower rectangular section. The front portion and the rear portion are joined at peripheral edges thereof to form an enclosure having an open bottom and an open top. The open top is formed at an apex of the upper triangular sections of the front and rear portions. The open top is dimensioned for receiving an upper hooked portion of a hanger therethrough.

1 Claim, 4 Drawing Sheets

GIFT WRAP GARMENT BAG

BACKGROUND OF THE INVENTION

1. Field of the Invention

The present invention relates to a gift wrap garment bag and more particularly pertains to providing a garment bag with ornamental features with a gift wrap garment bag. Such features included reinforced holes along the sides and at the top of the bag for receiving ribbons and bows.

2. Description of the Prior Art

The use of gift wrappers is known in the prior art. More specifically, gift wrappers heretofore devised and utilized for the purpose of wrapping or covering products are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,100,051 to Triglia et al. discloses a gift wrapper.

U.S. Pat. No. 5,407,125 to Yates et al. discloses reusable gift wrapping.

U.S. Pat. No. 5,358,106 to King et al. discloses a garment bag with overlapping closure flaps.

U.S. Pat. No. Des. 283,373 to Bomes et al. discloses the ornamental design for a soft-sided garment bag.

U.S. Pat. No. 5,090,559 to Gendreau discloses reusable garment bags for drycleaning.

U.S. Pat. No. 5,004,144 to Selga discloses a reusable fabric gift wrap.

While these devices fulfill their respective, particular objective and requirements, the aforementioned patents do not describe a gift wrap garment bag for providing a garment bag with ornamental features.

In this respect, the gift wrap garment bag according to the present invention substantially departs from the conventional concepts and designs of the prior art, and in doing so provides an apparatus primarily developed for the purpose of providing a garment bag with ornamental features.

Therefore, it can be appreciated that there exists a continuing need for new and improved gift wrap garment bag which can be used for providing a garment bag with ornamental features. In this regard, the present invention substantially fulfills this need.

SUMMARY OF THE INVENTION

In the view of the foregoing disadvantages inherent in the known types of gift wrappers now present in the prior art, the present invention provides an improved gift wrap garment bag. As such, the general purpose of the present invention, which will be described subsequently in greater detail, is to provide a new and improved gift wrap garment bag and method which has all the advantages of the prior art and none of the disadvantages.

To attain this, the present invention essentially comprises a bag comprising a front portion and a rear portion. The front portion and the rear portion each have an upper triangular section and a lower rectangular section. The front portion and the rear portion are joined at peripheral edges thereof to form an enclosure having an open bottom and an open top. The open top is formed at an apex of the upper triangular sections of the front and rear portions. The open top is dimensioned for receiving an upper hooked portion of a hanger therethrough. The front portion and the rear portion have reinforcement rings disposed therein inwardly of the peripheral edges thereof. Lower ends of the lower rectangular section of the front portion and the rear portion each have an aperture with a gusset disposed therein.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved gift wrap garment bag which has all the advantages of the prior art gift wrappers and none of the disadvantages.

It is another object of the present invention to provide a new and improved gift wrap garment bag which may be easily and efficiently manufactured and marketed.

It is a further object of the present invention to provide a new and improved gift wrap garment bag which is of durable and reliable construction.

An even further object of the present invention is to provide a new and improved gift wrap garment bag which is susceptible of a low cost of manufacture with regard to both materials and labor, and which accordingly is then susceptible of low prices of sale to the consuming public, thereby making such a gift wrap garment bag economically available to the buying public.

Even still another object of the present invention is to provide a new and improved gift wrap garment bag for providing a garment bag with ornamental features.

Lastly, it is an object of the present invention to provide a new and improved gift wrap garment bag including a bag comprising a front portion and a rear portion. The front portion and the rear portion each have an upper triangular section and a lower rectangular section. The front portion and the rear portion are joined at peripheral edges thereof to form an enclosure having an open bottom and an open top. The open top is formed at an apex of the upper triangular sections of the front and rear portions. The open top is dimensioned for receiving an upper hooked portion of a hanger therethrough.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
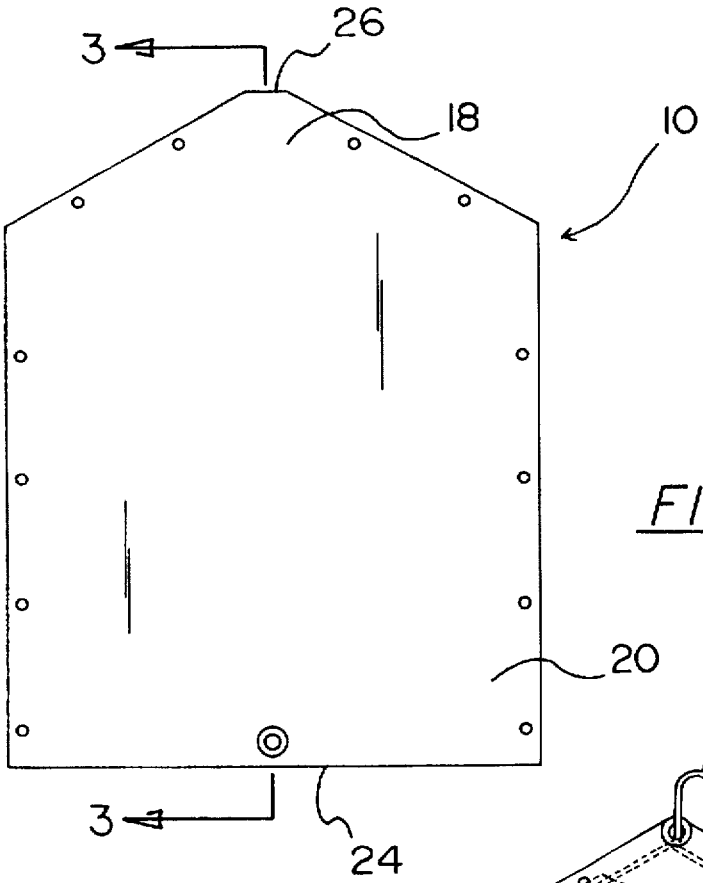
FIG. 1 is a front view of the preferred embodiment of the gift wrap garment bag constructed in accordance with the principles of the present invention.
Figure 2:
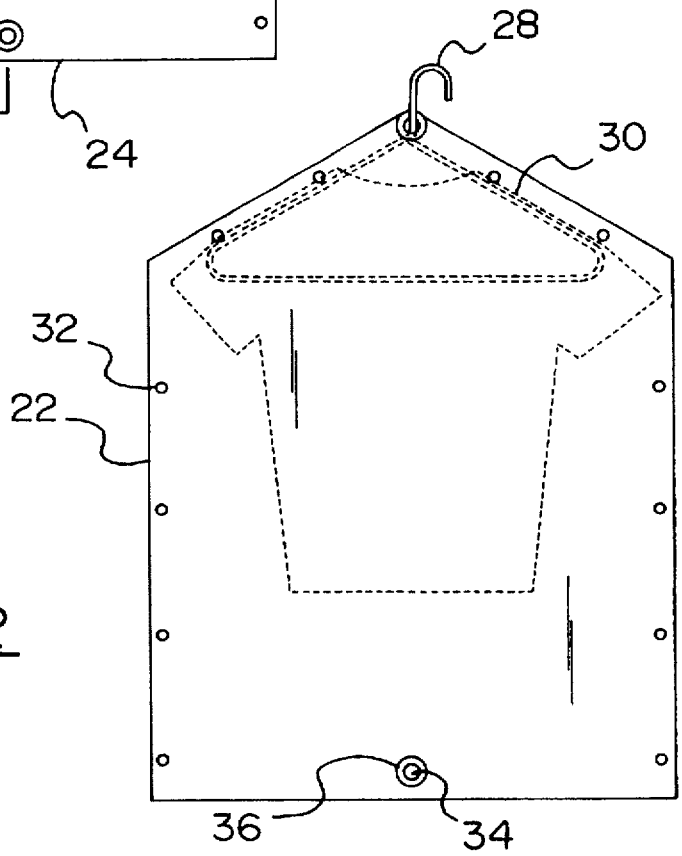
FIG. 2 is a front elevation view of the present invention with a shirt enclosed therein.
Figure 3:
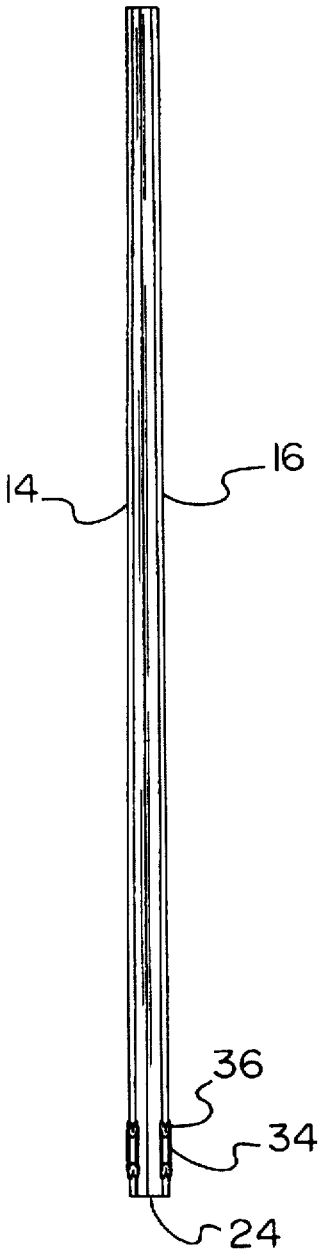
FIG. 3 is a cross-sectional view as taken along line 3—3 of FIG. 1.
Figure 4:
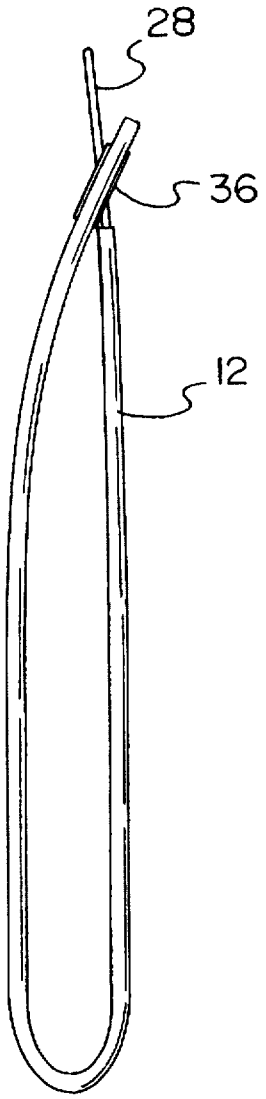
FIG. 4 is a side view of the present invention shown in a folded orientation.

With reference now to the drawings, and in particular, to FIGS. 1 through 8 thereof, the preferred embodiment of the new and improved gift wrap garment bag embodying the principles and concepts of the present invention and generally designated by the reference number 10 will be described.

Specifically, it will be noted in the various Figures that the device relates to a gift wrap garment bag for providing a garment bag with ornamental features. In its broadest context, the device consists of a bag. Such components are individually configured and correlated with respect to each other so as to attain the desired objective.

The device 10 includes a bag 12 comprising a front portion 14 and a rear portion 16. The front portion 14 and the rear portion 16 each have an upper triangular section 18 and a lower rectangular section 20. Note FIG. 1. The front portion 14 and the rear portion 16 are joined at peripheral edges 22 thereof to form an enclosure having an open bottom 24 and an open top 26. The open top 26 is formed at an apex of the upper triangular sections 18 of the front 14 and rear portions 16. The open top 26 is dimensioned for receiving an upper hooked portion 28 of a hanger 30 therethrough. Note FIG. 2. The front portion 14 and the rear portion 16 have reinforcement rings 32 disposed therein inwardly of the peripheral edges 22 thereof. The reinforcement rings 32 serve to maintain the tautness of the bag 12 thereby enabling the clothes to be received therein and also provide places for decorative ribbons and bows. Lower ends of the lower rectangular section 20 of the front portion 14 and the rear portion 16 each have an aperture 34 with a gusset 36 disposed therein. The gussets 36 allow for the bag 12 to be folded in half, as in FIG. 4, and be placed over the upper hooked portion 28 of the hanger 30. The gusset also allows for the insertion of a ribbon or cord which can be tied in a loop. This loop can dangle below the bag and be brought forward and upward and placed over the upper hooked portion of a hanger thereby allowing the bag to be folded in half for ease of carrying.

Figure 5:
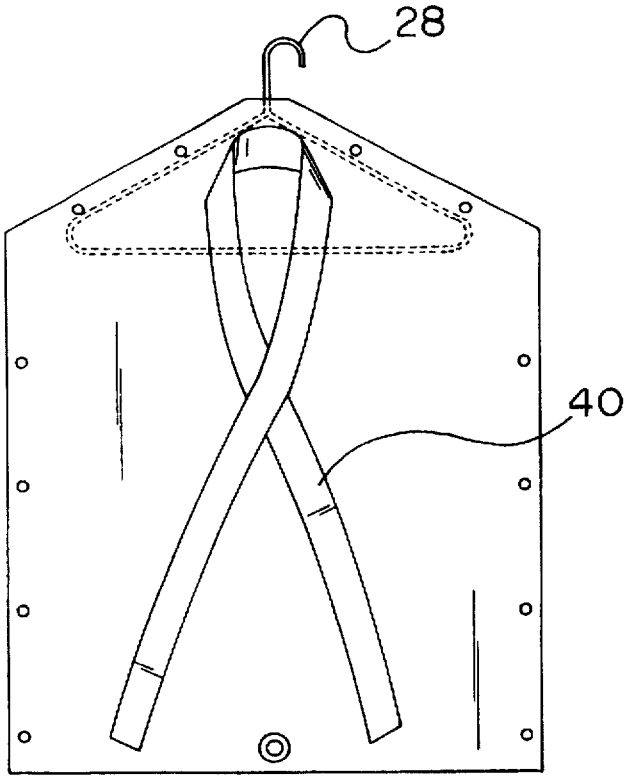
FIG. 5 is a front elevation of the present invention shown with an optional ribbon.

FIG. 5 illustrates the device 10 with an ornamental ribbon 40 in place on the bag 12. The ribbon 40 is placed across the front portion 14 of the bag to enhance the packaging of an item of apparel as a gift.

Figure 6:
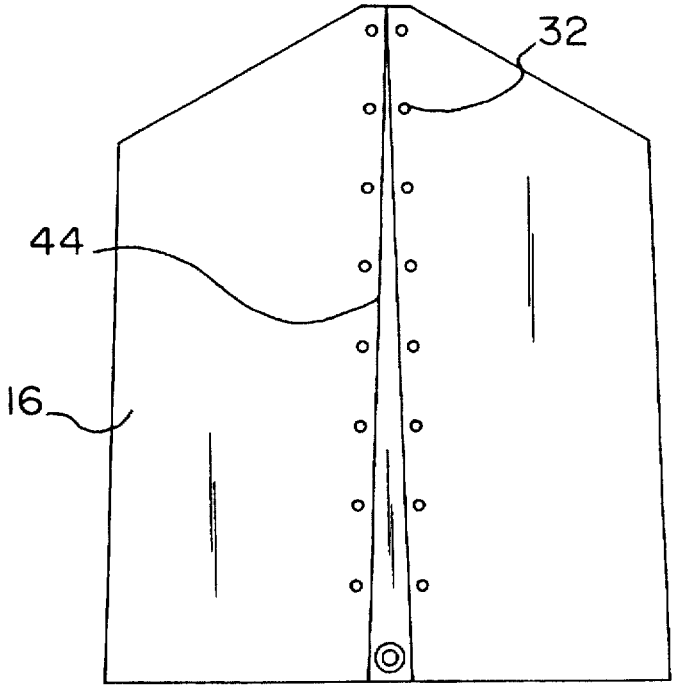
FIG. 6 is a front elevation view of a second embodiment of the present invention.

A second embodiment of the present invention is shown in FIG. 6 and includes the front portion 14 having a vertical slit 44 extending from the open top 26 to the open bottom 24. A lower end of the lower rectangular section 20 of the rear portion 16 only has the aperture 34 with the gusset 36 disposed therein. Reinforcement rings 32 are disposed on opposing edges of the vertical slit 44. The vertical slit 44 allows for easy placement of clothes within the bag 12. The reinforcing rings 32 on the opposing edges of the vertical slit 44 could also be used as a means of attaching ribbons and bows to the bag 12.

Figure 7:
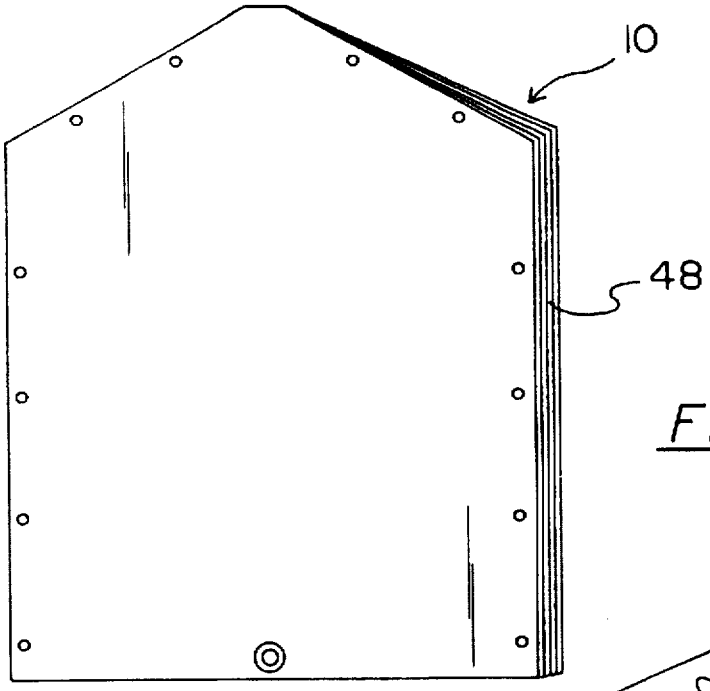
FIG. 7 is a front elevation view of a third embodiment of the present invention.

A third embodiment of the present invention is shown in FIG. 7 and includes substantially all of the components of the present invention further including pleats 48 formed in the joined peripheral edges of the front 14 and rear portions 16 and also along the top portion. The pleats 48 allow for the expansion of the bag 12 in order to accommodate a greater amount of hanging clothes.

Figure 8:
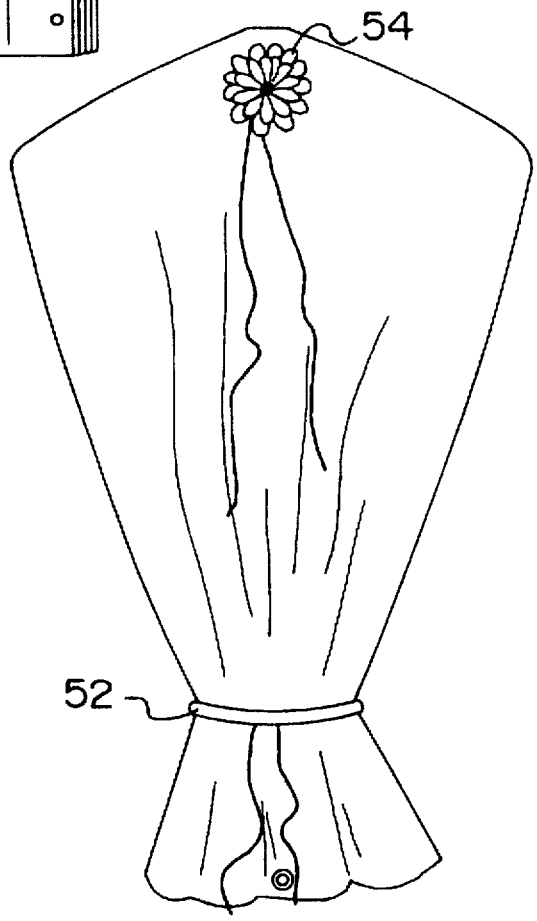
FIG. 8 is a front elevation view of a fourth embodiment of the present invention.

A fourth embodiment of the present invention is shown in FIG. 8 and includes substantially all of the components of the present invention further including a binding ribbon 52 disposed around the lower rectangular sections 20 of the front 14 and rear portions 16. The binding ribbon 52 serves as a closure means for the bag 12 thereby protecting the clothes therein. Additionally, FIG. 8 illustrates an ornamental ribbon 54 in the form of a flower.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

I claim:

1. A gift wrap garment bag for providing a garment bag with ornamental features comprising, in combination:

a bag comprising a front portion and a rear portion, the front portion and the rear portion each having an upper triangular section and a lower rectangular section, the front portion and the rear portion being joined at peripheral edges thereof to form an enclosure having an open bottom and an open top, the open top being formed at an apex of the upper triangular sections of the front and rear portions, the open top dimensioned for receiving an upper hooked portion of a hanger therethrough, the front portion and the rear portion having reinforcement rings disposed therein inwardly of the peripheral edges thereof for retaining tautness of the bag, lower ends of the lower rectangular section of the front portion and the rear portion each having an aperture with a gusset disposed therein, the gussets allowing for the bag to be folded in half for placement over the upper hooked portion of the hanger for carrying.

* * * * *